US007647868B2

(12) United States Patent
Schneider et al.

(10) Patent No.: US 7,647,868 B2
(45) Date of Patent: Jan. 19, 2010

(54) METHOD FOR FEEDING A PRINTING FORME TO A FORME CYLINDER OF A PRINTING PRESS

(75) Inventors: Georg Schneider, Würzburg (DE); Karl Robert Schäfer, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 507 days.

(21) Appl. No.: 11/596,217

(22) PCT Filed: Apr. 5, 2005

(86) PCT No.: PCT/EP2005/051511

§ 371 (c)(1),
(2), (4) Date: Nov. 14, 2006

(87) PCT Pub. No.: WO2005/110755

PCT Pub. Date: Nov. 24, 2005

(65) Prior Publication Data

US 2008/0028966 A1 Feb. 7, 2008

Related U.S. Application Data

(60) Provisional application No. 60/571,493, filed on May 17, 2004, provisional application No. 60/571,494, filed on May 17, 2004.

(30) Foreign Application Priority Data

May 14, 2004 (DE) ..... 10 2004 024 427
May 14, 2004 (DE) ..... 10 2004 024 442
Jul. 6, 2004 (DE) ..... 10 2004 032 550
Aug. 20, 2004 (DE) ..... 10 2004 040 693

(51) Int. Cl.
*B41F 27/12* (2006.01)

(52) U.S. Cl. ..... 101/477; 101/481; 101/485

(58) Field of Classification Search ..... 101/477, 101/485, 481, 483, 484, 480
See application file for complete search history.

(56) References Cited

U.S. PATENT DOCUMENTS 5,526,747 A 6/1996 Marmin et al.
5,661,566 A 8/1997 Gerber
5,806,431 A 9/1998 Muth
6,257,141 B1 7/2001 Hashimoto et al.

(Continued)

FOREIGN PATENT DOCUMENTS

DE 196 09 084 A1 9/1996

(Continued)

*Primary Examiner*—Leslie J Evanisko
(74) *Attorney, Agent, or Firm*—Jones, Tullar & Cooper, P.C.

(57) ABSTRACT

A printing plate is produced having at least one edge which has been cut so that it is parallel to a line of delimitation of the type area of the plate. The printing plate is fed to an impression cylinder of a printing press, in an axial direction of the impression cylinder by use of a plate feeding and alignment device. During the process of feeding the printing plate to the impression cylinder, the at least one edge of the plate, which was cut parallel to the type line of determination, is guided against at least one stop.

11 Claims, 7 Drawing Sheets

U.S. PATENT DOCUMENTS

| | | | | |
|---|---|---|---|---|
| 2003/0056671 | A1 * | 3/2003 | Hashiguchi | 101/477 |
| 2004/0020386 | A1 * | 2/2004 | Koyanagi et al. | 101/415.1 |
| 2005/0000381 | A1 | 1/2005 | Schneider et al. | |
| 2005/0172846 | A1 | 8/2005 | Schneider et al. | |

FOREIGN PATENT DOCUMENTS

| | | | |
|---|---|---|---|
| DE | 195 39 453 | A1 | 4/1997 |
| DE | 196 20 997 | A1 | 11/1997 |
| DE | 199 19 263 | A1 | 10/2000 |
| DE | 101 58 158 | A1 | 6/2003 |
| DE | 103 14 344 | B3 | 8/2004 |
| EP | 0 678 383 | A1 | 2/1995 |
| EP | 0 808 714 | A2 | 11/1997 |
| EP | 1 002 646 | B1 | 3/2003 |
| GB | 706118 | | 3/1954 |
| JP | 05000503 | A | 1/1993 |
| WO | WO 03/047861 | A2 | 6/2003 |
| WO | WO 03/047861 | A3 | 6/2003 |
| WO | WO 2004/020202 | A2 | 3/2004 |

* cited by examiner

METHOD FOR FEEDING A PRINTING FORME TO A FORME CYLINDER OF A PRINTING PRESS

CROSS-REFERENCE TO RELATED APPLICATIONS

This application is the U.S. national phase, under 35 USC 371, of PCT/EP2005/051511, filed Apr. 5, 2005; published as WO 2005/110755 A1 on Nov. 24, 2005 and claiming priority to DE 10 2004 024 442.1, filed May 14, 2004; to DE 10 2004 024 427.8, filed May 14, 2004; to U.S. 60/571,493 filed May 17, 2004; to U.S. 60/571,494, filed May 17, 2004; to DE 10 2004 032 550.2 filed Jul. 6, 2004 and to DE 10 2004 040 693.6, filed Aug. 20, 2004, the disclosures of which are expressly incorporated herein by reference.

FIELD OF THE INVENTION

The present invention is directed to a method for feeding a printing forme to a forme cylinder of a printing press, to a method for producing a printing forme, and to a device for laterally aligning and guiding a dressing to be fed to a printing press cylinder. Markings are applied to at least one side of the printing forme. At least one edge of the printing forme is trimmed parallel to a boundary line of a print area of the printing forme based on these markings.

BACKGROUND OF THE INVENTION

DE 101 58 158 A1 discloses a device for use in positioning a rubber blanket on a cylinder of a printing press. At least one stop, that acts in the axial direction of the cylinder, is disposed outside of the cylinder and can be pivoted into an infeed plane for the rubber blanket. This stop is used to feed the rubber blanket to the cylinder precisely positioned in an axial direction. The rubber blanket is pressed against the lateral stop by, for example, the force of a spring.

DE 196 20 997 A1 and EP 0 808 714 A2 disclose devices and methods for axially positioning a printing plate. A lateral stop for a lateral register device, which lateral stop is arranged between a forme cylinder and a printing plate preparation device, can preferably be steplessly positioned in an adjustment area that is oriented parallel to the forme cylinder. A gripper device presses the printing plate, which printing plate is to be fed to the forme cylinder from the printing plate preparation device, against the positioned lateral stop. The position of the lateral stop is preselected such that a printing plate that is guided on this lateral stop can be fed to the forme cylinder in the correct position. Additionally, another lateral stop for the printing plate that is to be fed to the forme cylinder can also be provided on either the forme cylinder or on the printing plate preparation device. Multiple printing plates can be arranged on the forme cylinder, side by side in the forme cylinder axial direction, and another lateral stop on either the forme cylinder or on the printing plate preparation device can be allocated to each of these multiple printing plates.

A method for producing multiple printing plates for printing presses is known from DE 196 09 084 A1. The printing plates are produced especially at least partially in an image generating system. Directional features are cut into each printing plate and are used to align each printing plate as it is installed on the rotary drum of a printing press. In addition to the lateral image on each printing plate, visible markings are applied to the surface of each printing plate. These visible markings can be optically detected and can serve to determine the position of directional cut-outs to be placed in each printing plate. These cut-outs can then be placed in these positions in each printing plate.

A processing device for use in preparing printing plates for offset printing presses via the mechanical processing of the respective printing plate for custom mounting on the respective printing press is known from DE 199 19 263 A1. This mechanical processing, and particularly the punching of centering holes, and also a trimming of the plate size, results in a precisely defined reference to the actual position of the printed image by the use of exposed optical markings in a clearly defined relation based upon the position of a printed image. The markings that are based on the printed image are preferably disposed in the edge area of the printing plate which lies outside of the usable printed image.

From EP 0 678 383 A1 there is known a device for exchanging printing formes on rotary printing presses. A printing forme, that is to be fed to a printing forme cylinder, can be aligned against a lateral stop.

SUMMARY OF THE INVENTION

The object of the present invention is directed to providing a method for feeding a printing forme to a forme cylinder of a printing press, to providing a method for producing such a printing forme and to providing a device for laterally aligning and guiding a dressing that is to be fed to a cylinder of a printing press. A rubber blanket or dressing, and preferably a printing forme, can be fed, in its correct position, to the cylinder, and preferably to the forme cylinder, of the printing press, in an axial direction using the device, in accordance with the present invention.

The object is attained, in accordance with the present invention with the application of markings to at least one side of a printing forme. At least one edge of the printing forme is trimmed parallel to a boundary line of a type area on the printing forme based on those markings. At least the side of the printing forme which bears the markings is bent down. The printing forme is fed by a plate feeding device, to the forme cylinder, precisely positioned in its axial direction. During infeeding of the plate or forme, at least the one trimmed edge of the printing forme is guided on at least one stop of the plate feeding device in an axial direction with respect to the forme cylinder. The working surface of the printing forme, which is imaged with the print image, can be delineated by two parallel lines.

The benefits to be achieved in accordance with the present invention consist especially in that a dressing, such as a rubber blanket, and preferably a printing forme, is fed, in its correct position, to the cylinder, and preferably to the forme cylinder, of the printing press, in an axial direction using the device of the present invention. Furthermore, jamming of the dressing or rubber blanket to be fed in is effectively prevented, as the dressing is being fed to the cylinder. Further advantages are to be found in the following description of the present invention.

BRIEF DESCRIPTION OF THE DRAWINGS

One preferred embodiment of the present invention is represented in the set of drawings and will be described in greater detail below.

The drawings show in.

DESCRIPTION OF THE PREFERRED EMBODIMENTS

In the field of multicolor printing, it is particularly important with respect to the quality of a printed product to be produced that printing formes which are used in printing the same printed image, and which are located in printing groups of a printing press that are sequential in the printing process, be arranged, register-true, on their respective forme cylinder. This alignment or registration is important in order to print color patches of the printed product. These color patches are different from one another and are printed by different printing groups but are part of the same printed image which is imprinted onto the printing substrate. Each color patch must be printed such that they fit precisely on top of, or with respect to one another. In order to enable a register-true, and particularly to enable a laterally register-true alignment and feeding of printing formes to their respective forme cylinder, the printing formes that are used in the printing process are prepared, in accordance with the present invention, as will be described in what follows.

Figure 1:
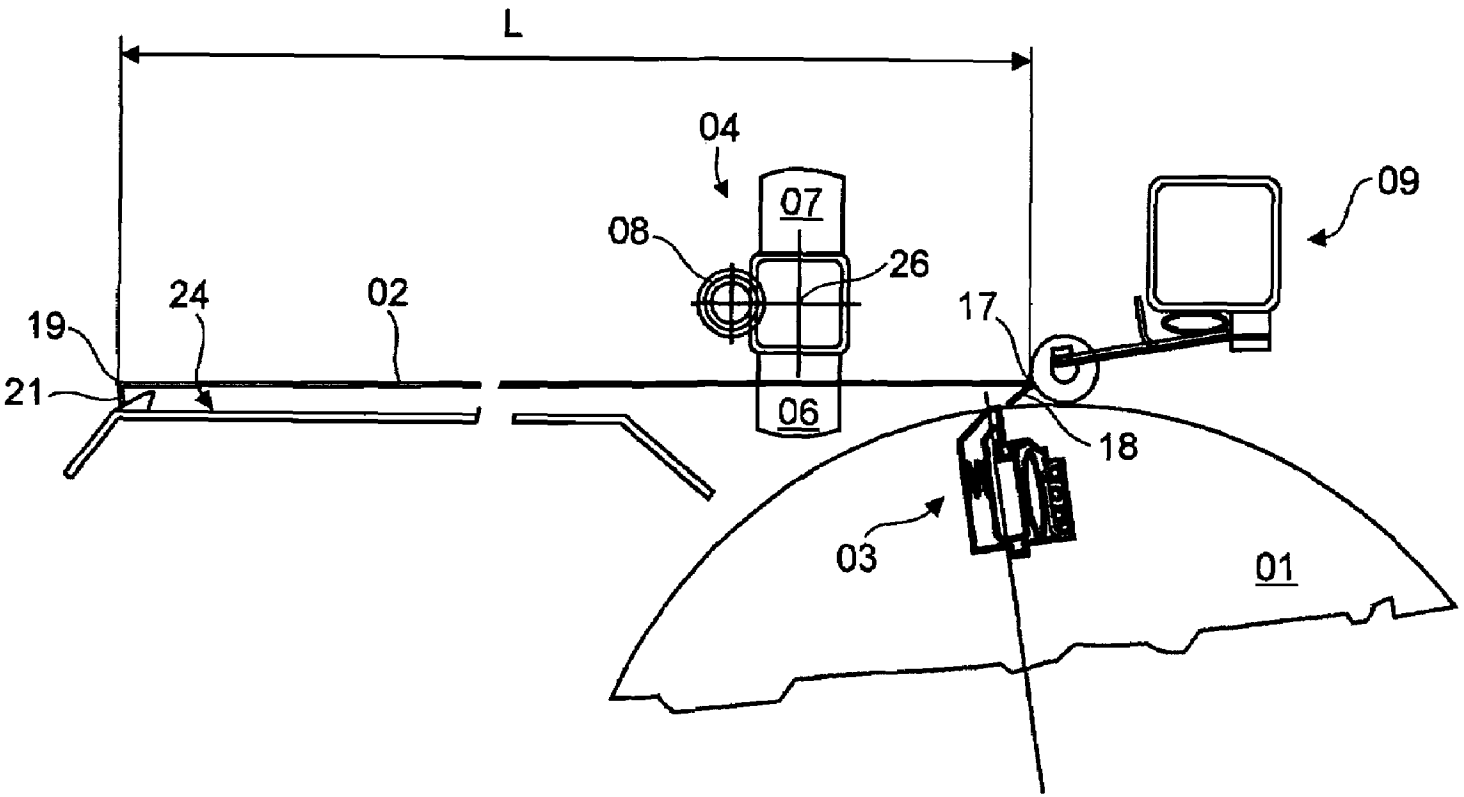
FIG. 1 a side elevation view of a device in accordance with the present invention and with a printing forme that is to be fed to a forme cylinder.
Figure 2:
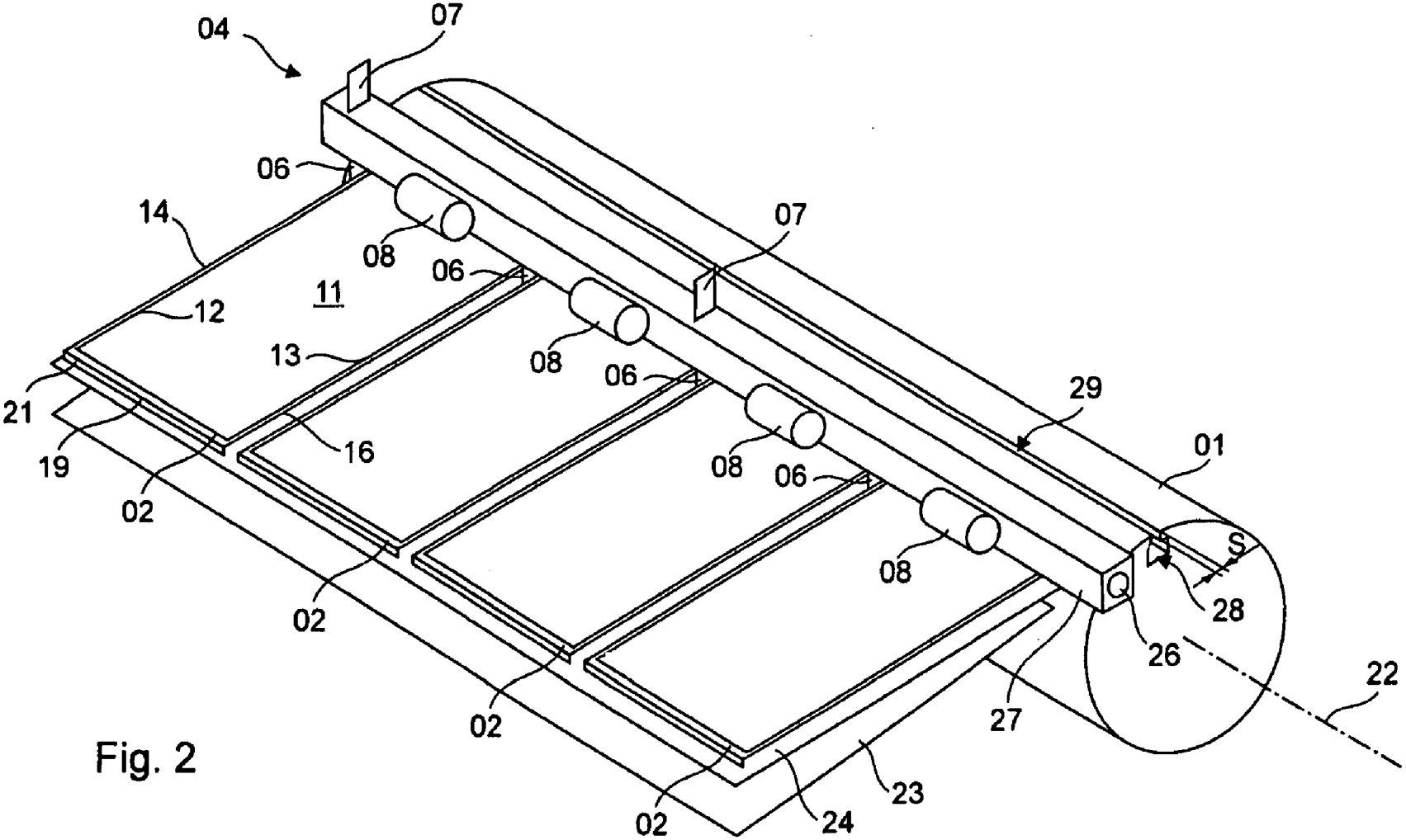
in FIG. 2 a perspective view of the device of the present invention with multiple printing formes to be fed in, and arranged side by side in an axial direction of the forme cylinder.
Figure 3:
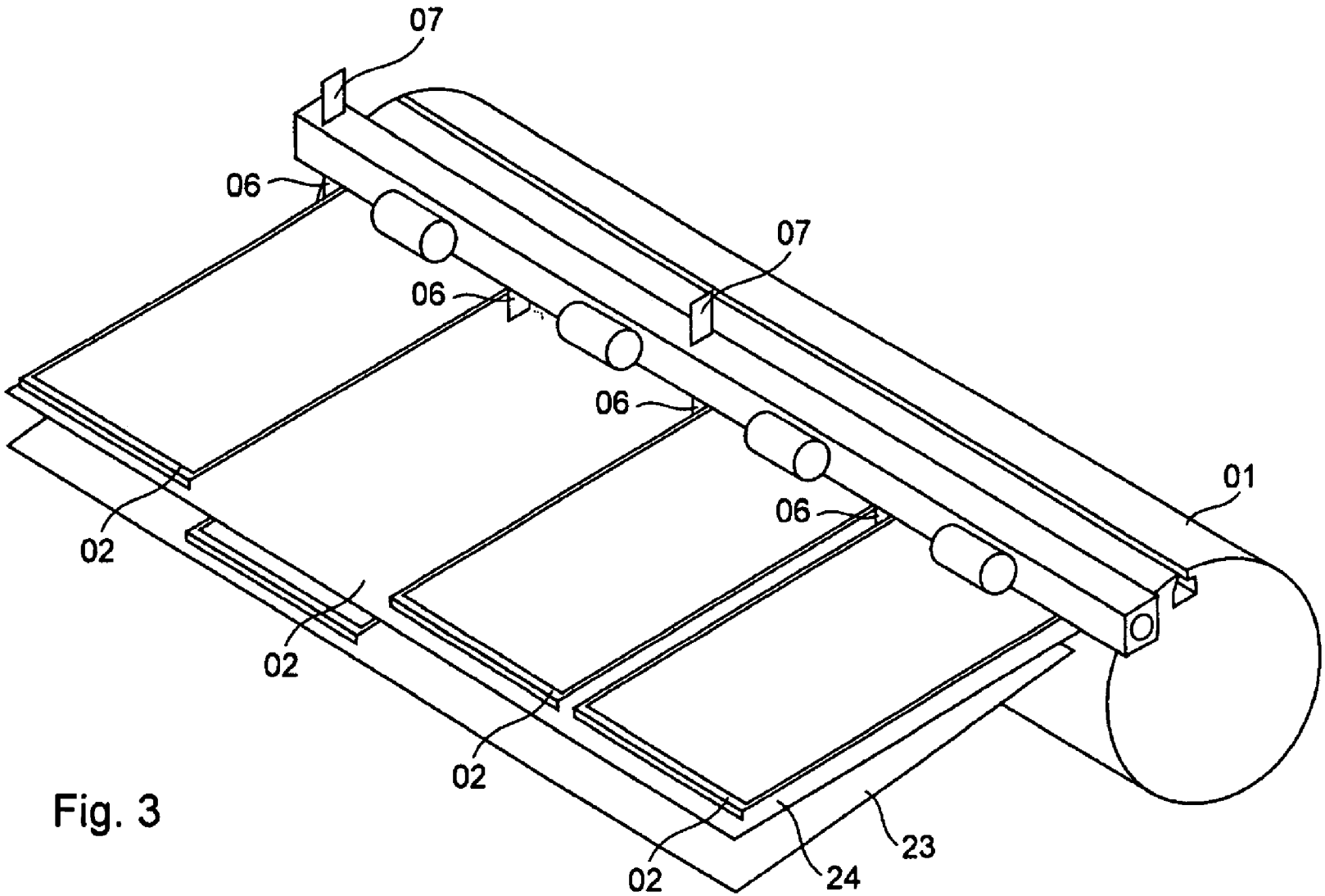
in FIG. 3 a perspective view of the device of the present invention with multiple printing formes to be fed in, and arranged side by side in the axial direction of the forme cylinder, and with one printing forme arranged to be unloaded from the forme cylinder.

Referring initially to FIG. 1, a dressing, such as a printing forme 02, which is to be used, for example, in an offset printing process, is produced in such a way that a blank printing forme is imaged with a printed image and its shape is adjusted for its intended use in a printing press, as depicted schematically in FIGS. 2 and 3. The blank printing forme can be comprised, for example, of a thin, flexible, rectangular plate, with its length and width measurements each having a permissible limit of, for example, ±1 mm. This large permissible limit is not acceptable especially for use in the production of printing formes 02 to be used in multicolor printing. Registrations, or registers in the printing process, such as, for example, lateral registers, circumferential registers, and color registers, must be adjusted, for example, with a precision of between 0.005 mm and 0.03 mm, and preferably between 0.01 mm and 0.02 mm, in order to produce a qualitatively acceptable printed product having a printed image of sufficient image sharpness.

The surface of the printing forme 02 that is to be imaged is denoted as its working surface. The working surface of the printing forme 02 is imaged with a printed image, such as, for example, photographically, by the use of an imaging device or in an imaging device, and with the printed image being positioned within a type area 11 that is delimited by two parallel lines 12 and 13, as seen in FIG. 2. The two parallel lines 12; 13 of the type area 11 are aligned parallel to a direction of transport of a printing substrate, which is intended to receive the printed image, in the printing process in the printing press. Once the working surface has been imaged, at least one edge 14 of the printing forme 02 is trimmed parallel to the two parallel lines 12; 13 of the type area 11. Preferably, two parallel edges 14; 16 of the printing forme 02 are trimmed so that both are parallel to the two parallel lines 12; 13 of the type area 11. Such trimming of the edges 14 and 16 of the forme 02 is done following the imaging of the working surface. The trimming of the at least one edge 14; 16 of the printing forme 02 occurs based upon the printed image which has been applied to the type area 11 printing forme 02, so that at least this one edge 14; 16 is always aligned parallel to the type area 11. The trimmed edge 14; 16 thus always has a fixed reference to the printed image which has been applied to the printing forme 02. This step is advantageous, since a register-true alignment of the printed image is thereby facilitated. If the printing forme 02 is fed to a forme cylinder 01 of the printing press in a direction which is exactly parallel to the direction of transport of the printing substrate that receives the printed image, and is mounted on the forme cylinder 01 in that location, then corresponding adjustment devices, such as, for example, register pins or similar devices, for use in accomplishing the register adjustment of the printing forme 02, are no longer necessary.

In the process for producing the register-true printing forme 02 in accordance with the present invention, the forme is preferably mounted, in the plane of its working surface, such that it can be shifted in two directions which are orthogonal to one another. The shifting path lies within the range of a few hundredths of a millimeter. The printing forme 02 is also preferably mounted, in the plane of its working surface, such that it can rotate around an axis that is perpendicular to the working surface of the printing forme 02. To this end, an XY platform that is also rotatable can be provided, which XY platform ensures high positioning precision for the printing forme 02 that rests upon it.

The printing forme 02 is preferably equipped with a side 18, as may be seen in FIG. 1, that is bent down at an angle along at least one edge 17 that is orthogonal to its at least one trimmed edge 14; 16. The bent-down side 18 serves in the mounting of the printing forme 02 on a forme cylinder 01. The downward bending of the side 18 preferably takes place after the trimming of the edge 14; 16. This bent side 18 is especially disposed on the advancing or leading end of the printing forme 02. The downward bending angle, which is typically measured starting, for example from the working surface of the printing forme 02, can measure between 45° and 135°, and preferably can measure, for example, 45°±10° or 90°±10°. The side 18 is bent in a direction that faces away from the working surface of the printing forme 02, as may also be seen in FIG. 1. The printing forme 02 can preferably also be equipped on each of its two edges 17; 19 that are orthogonal to its trimmed edge 14; 16 with a side 18; 21 that is bent down at an angle. In other words, the printing forme 02 can also have an angled side 21 on its trailing end 19. In the depictions of FIG. 2 and FIG. 3, the leading edge 17 and the bent down side 18 of the printing forme 02 structured thereon are not visible. The working surface of the printing forme 02 is preferably structured to be rectangular, wherein the working surface is preferably delimited by the two parallel trimmed edges 14; 16 and by the two bent edges 17; 19 that are at right angles to the two trimmed edges 14; 16. The bending angle of the bent down sides 18; 21 is preferably selected such that the printing forme 02 can be fed automatically using a device, and preferably by using a remotely actuatable adjustment device. The printing forme 02 can likewise be automatically mounted and fastened to the circumferential surface of the forme cylinder 01.

In the process for producing a register-true printing forme 02, and particularly in connection with the imaging of the printing forme 02, its working surface is provided with at least two markings which are spaced from one another, and with which markings the at least one edge 14; 16 of the printing forme 02 that is to be trimmed is aligned parallel to the two lines 12; 13 of the type area 11. The markings can be applied to the working surface of the printing forme 02 outside of the type area 11. However, it is advantageous to form the markings inside the type area 11 and/or in the area of the at least one side 18; 21 that is to be bent down, and particularly on one of the sides 18; 21 that is to be bent down. It is advantageous to place markings, which are applied within the type area 11, on the working surface of the printing forme 02 near the bending edges 17; 19, so that the markings are spaced the greatest possible distance from one another. Thus, a distance L between the markings, that extends nearly over the entire length of the printing forme 02, is advantageous, as seen in FIG. 1. The markings can also be structured as a part of the printed image. The markings are preferably machine-detectable and may be formed, for example, as a cross or as a circle. The markings are structured such that they can preferably be detected with a sensor, such as, for example, with an optical sensor, and particularly with a video camera. The sensor provides its output signal to a control device that evaluates the output signal. A sensor, which is structured as a video camera, provides its output signal to an image-evaluating control device.

The printing forme 02, which is mounted in an adjustment device during its production, such that it can be shifted and/or rotated, is aligned in its position, for example by the control device and based upon the detected markings, prior to the trimming of its edge or edges 14; 16 and/or prior to the bending of its side or sides 18; 21. In addition, the printing forme 02, that is aligned in the adjustment device, is fixed in place in its aligned position prior to the trimming of its edge or edges 14; 16 and/or prior to the bending of its side or sides 18; 21, such as, for example, by the use of a suction device. This fastening is preferably released only after the edge or edges 14; 16 of the printing forme 02 has/have been trimmed, and/or after the side or sides 18; 21 has/have been bent. The printing forme 02 that is aligned in its position remains fixed in place during its mechanical processing, which mechanical processing involves trimming and/or bending of the edge or edges 14; 16. Accordingly, trimming and bending of the edge or edges 14; 16 preferably occurs without any intermediate change in the position of the aligned printing forme 02.

It is a particular advantage that the printing forme 02, which is produced in accordance with the above-described manner, is structured without register punching and is ready for use in the printing press, without having such register punching.

The printing forme 02, which has been produced using the above-described process, is fed to the forme cylinder 01 of the printing press. At least the one edge 14; 16, which is trimmed after the imaging of its working surface parallel to the parallel lines 12; 13 of the type area 11, is aligned laterally to this forme cylinder 01 for a register-true positioning, and is mounted on the forme cylinder 01 during the infeed. In addition to causing the arrangement of the printing forme 02 in the correct position, the lateral alignment of the printing forme 02 also causes the trimmed edge 14; 16 of the printing forme 02, and thereby also causes the lines 12; 13 of its type area 11 that are parallel to this edge 14; 16, to be aligned orthogonally to the axis 22 of the forme cylinder 01. In each of FIGS. 1, 2 and 3 of the drawings only a single forme cylinder 01 is shown. However, it is understood that the device of the present invention can be provided for all the printing groups which are involved in the printing process for a specific printed product, so that multiple devices of this type can be arranged in the same printing press. For purposes of clarity, a representation of such multiple devices is dispensed with in the present drawings.

A device for use in feeding a rubber blanket 02, that is produced to be register-true, in accordance with the present invention, and preferably a printing forme 02 that is produced to be register-true, to a forme cylinder 01, will now be described in greater detail. The precisely positioned infeed of the printing forme 02 to the forme cylinder 01, in an axial direction, is accomplished, for example, on a platform or out of a magazine, and preferably is done in such a way that an end of the printing forme 02 that is bent down can be inserted into a channel 28 which extends in the longitudinal direction of the forme cylinder 01 and which channel 28 is situated beneath the circumferential surface of the forme cylinder 01. The channel 28 on the circumferential surface of the forme cylinder 01 has, for example, a slit-shaped opening 29, preferably having a slit width S of between 1 mm and 3 mm, as may be seen in FIG. 2 and 3. A plate or forme end holding device 03 is arranged in the channel 28. The plate or forme end holding device 03 is structured, in the preferred embodiment, as a clamping device 03 which is arranged in the channel 28, as seen in FIG. 1. The leading and trailing ends of the printing forme 02 can, however, also be held in place by virtue of the shaping or the bending over of the ends and the cooperative shape of the channel 28, without a clamping device 03, i.e. merely via a form engagement. In order for the printing forme 02 to be fed and, if applicable, to be fastened in the correct position relative to the axial direction of the forme cylinder 01, and specifically in an orthogonal alignment with respect to the axial direction of the forme cylinder 01, a device 04 for use in guiding the printing forme 02, which has been produced to be register-true, is provided outside of the forme cylinder 01.

The device 04 for guiding the printing forme 02 has, for example, a pivoting axis 26 that, as may be seen in FIG. 2, is essentially parallel to the axis 22 of the forme cylinder 01, and which extends in its longitudinal direction, and around which pivot axis 26 at least one stop 06; 07 is able to pivot. This stop 06; 07 is, for example, pivoted out for an operational situation in which no printing forme exchange is to take place, and is pivoted in when a printing forme 02 is to be fed in. Over the usable length of the forme cylinder 01, which forme cylinder usable length corresponds essentially to the width of, for example, four printed pages, such as, for example, four newspaper pages, four stops 06 of this type, with one stop for each of the four printing formes 02, are preferably arranged on a shaft. The printing formes are pressed, for example by the use of spring force, which is not shown here, against the respective lateral stop 06; 07. In addition, two stops 07 are provided, for example, over the length of the forme cylinder 01 or the shaft, which two stops 07 can be pivoted in when double-width printing formes 02 are to be used. The pivotable stops 06; 07 can be integrated, for example, into an assembly of a fully automatic or of a semiautomatic plate changer. The axial position of the stops 06; 07, which are provided, for example, as thin plates or "wings" on a cross member 27, such as, for example, a square tube, that is to be pivoted, can be adjusted separately. Alternatively, the entire device 04 for guiding the printing forme 02 can be adjusted. To change their respective positions, the stops 06; 07 can each be arranged so as to be capable of shifting on the cross member 27, in the axial direction 22 of the forme cylinder 01, at least within a defined adjustment area.

In a further development of the present invention, the device 04 for guiding the printing forme 02 is equipped with a roller 08 or with multiple rollers 08, on a side of the device 04 that is different from that of the stops 06; 07. These rollers 08, in the process of unloading the printing forme 02 from the forme cylinder 01, and after the corresponding pivoting of the device 04 for guiding the printing forme 02, hold down the printing forme 02 that is to be accepted, so that the latter comes to rest precisely positioned on the platform, for example on a stop 06; 07. A further auxiliary device 09, as seen in FIG. 1, and which is usable for positioning or for unloading the printing forme 02, can likewise comprise a roller or multiple adjustable rollers.

In order for this device 04, for use in the lateral alignment of at least one printing forme 02, to be fed to a forme cylinder 01 of a printing press, and wherein at least one stop 06; 07 that acts in the axial direction of the forme cylinder 01, and that laterally aligns the printing forme 02 to be fed in, is arranged outside of the forme cylinder 01 in an infeed plane of the printing forme 02, it is preferably provided that a printing forme 02, which was previously fed in, or another printing forme 02 which is arranged on the forme cylinder 01, can be unloaded from the forme cylinder 01 in an unloading plane 23 for the printing forme 02. If the stop 06; 07 extends at least partially into the unloading plane 23 during the infeed of the printing forme 02, it must be ensured that the stop 06; 07 is removed from the unloading plane 23 during unloading of the printing forme 02. For this reason, the stop 06; 07 is guided out of the unloading plane 23, such as, for example, via a pivoting motion, in order to avoid impeding the unloading of the printing forme 02.

FIG. 3 shows multiple printing formes 02 which are to be fed in, and which are arranged side by side in the axial direction of the forme cylinder 01. FIG. 3 also depicts one printing forme 02 to be unloaded from the forme cylinder 01. The printing forme 02 to be unloaded is led off from the forme cylinder 01 beneath the infeed plane 24. In the representation which is shown in FIG. 3, the infeed plane 24 largely conceals the printing forme 02 that is to be unloaded, and which is situated in its unloading plane 23.

The infeed plane 24 for the printing forme 02 and the unloading plane 23 for the printing forme 02 are preferably arranged offset from one another and, for example, may be offset vertically from one another, as seen in FIG. 2 and 3. In a particular embodiment, the infeed plane 24 for the printing forme 02 and the unloading plane 23 for the printing forme 02 can overlap at least partially. In other words, unloading plane 23 and in feed plane 24 can be at least partially congruent and can even be identical. The stop 06; 07 is arranged so as to be capable of pivoting around the pivoting axis 26, which pivoting axis 26 is essentially parallel to the longitudinal axis of the forme cylinder 01, to move the stop 06; 07 into the infeed plane 24 of the printing forme 02 or out of that plane. The stop 06; 07 is preferably arranged on a pivotable cross member 27, as seen in FIGS. 4-7. Using the stop 06; 07, the printing forme 02 can be fed to the forme cylinder 01 in an axial direction, precisely positioned. The axial position of the stop 06; 07 is preferably structured so as to be adjustable. The stop 06; 07 can thereby assume different operational positions, as needed. If multiple, such as, for example, four such stops 06 are provided, and are spaced axially from one another, over the length of the forme cylinder 01, then these stops 06 can preferably be pivoted simultaneously. However, stops 06; 07, which are arranged at different axial positions, can also engage at different times in the unloading plane 23 for the printing forme 02. Accordingly, different operational positions for the device 04 for guiding the printing forme 02 are defined as a result of the pivoting movement of the device 04 around the pivoting axis 26. These operating positions define whether even one of the stops 06; 07 engages in the infeed plane 24 and/or in the unloading plane 23 for the printing forme 02, and if so, which of the stops 06; 07 engages in the infeed plane 24 and/or in the unloading plane 23 for the printing forme 02.

One stop 06, for use in aligning a narrow printing forme 02 engages that narrow printing forme 02, in the unloading plane 23 for the narrow printing forme 02, at a different time from a stop 07 that aligns a wide, panoramic printing forme 02. A panoramic printing forme 02 typically has, for example, double the width of a normal width printing forme 02 in the axial direction of the forme cylinder 01. Likewise, stops 06; 07 which are arranged in different axial positions can be removed from the unloading plane 23 for the printing forme 02 at different times from one another. Furthermore, in one operational setting, stops 06; 07 which are arranged at different axial positions, are removed simultaneously from the unloading plane 23. The device 04 for guiding the printing forme 02 is remotely actuatable with respect to its various operational settings, preferably via a control device that is assigned to the printing press, and which may be, for example, a control station.

Each stop 06; 07 acts upon a lateral edge of the printing forme 02, and especially acts on at least one of the trimmed edges 14; 16, which trimmed edge is aligned parallel to the printed image that has been applied to the printing forme 02, i.e. parallel to a boundary line 12; 13 of the type area 11 of the printing forme 02. Because the printing forme 02, at least one trimmed edge 14; 16 of which is arranged at a fixed relationship to the printed image, which is applied to the printing forme 02, is fed to the forme cylinder 01 in an alignment that is precisely positioned as a result of the stop 06; 07, this printing forme 02 can be mounted, register-true, on the circumferential surface of the forme cylinder 01. Such mounting of the printing forme 02 can be accomplished without requiring any additional adjustment elements for use in registering this printing forme 02.

To effectively prevent a jamming of the printing forme 02, as it is being fed into the forme cylinder 01, at least one stop 06; 07 is located on both sides of the printing forme 02 being fed in, which sides extend along the direction of infeed. Each of the at least one stop 06; 07 acts in the axial direction of the forme cylinder 01 and laterally aligns the printing forme 02 to be fed in. Each such stop 06; 07 is arranged outside of the forme cylinder 01. One of these two stops 06; 07, that laterally align the printing forme 02 to be fed in, is mounted in a bearing 31 with a spring element 32 that acts in the axial direction of the forme cylinder 01, as seen in FIG. 7. The stop 06; 07 that is mounted in this bearing 31 can be shifted in the axial direction of the forme cylinder 01 against a force that is exerted by the spring element 32, as may be seen in FIG. 6 and 7. Thereby, at least one printing forme 02 that is to be fed to the forme cylinder 01, and preferably each such printing forme 02 that is to be fed to the forme cylinder 01, is guided laterally between a stop 06; 07 that is rigid in the axial direction of the forme cylinder 01 and one that is flexibly mounted.

Preferably, the bearing 31 with the spring element 32 that acts in the axial direction of the cylinder 01 is arranged in, or on the cross member 27 that also extends in the axial direction of the cylinder 01. In the preferred embodiment, for each of the printing formes 02 that are arranged side by side in the axial direction of the forme cylinder 01, one stop 06; 07 that is mounted in a bearing 31, with a spring element 32 that acts in the axial direction of the forme cylinder 01, is provided.

Figure 4:
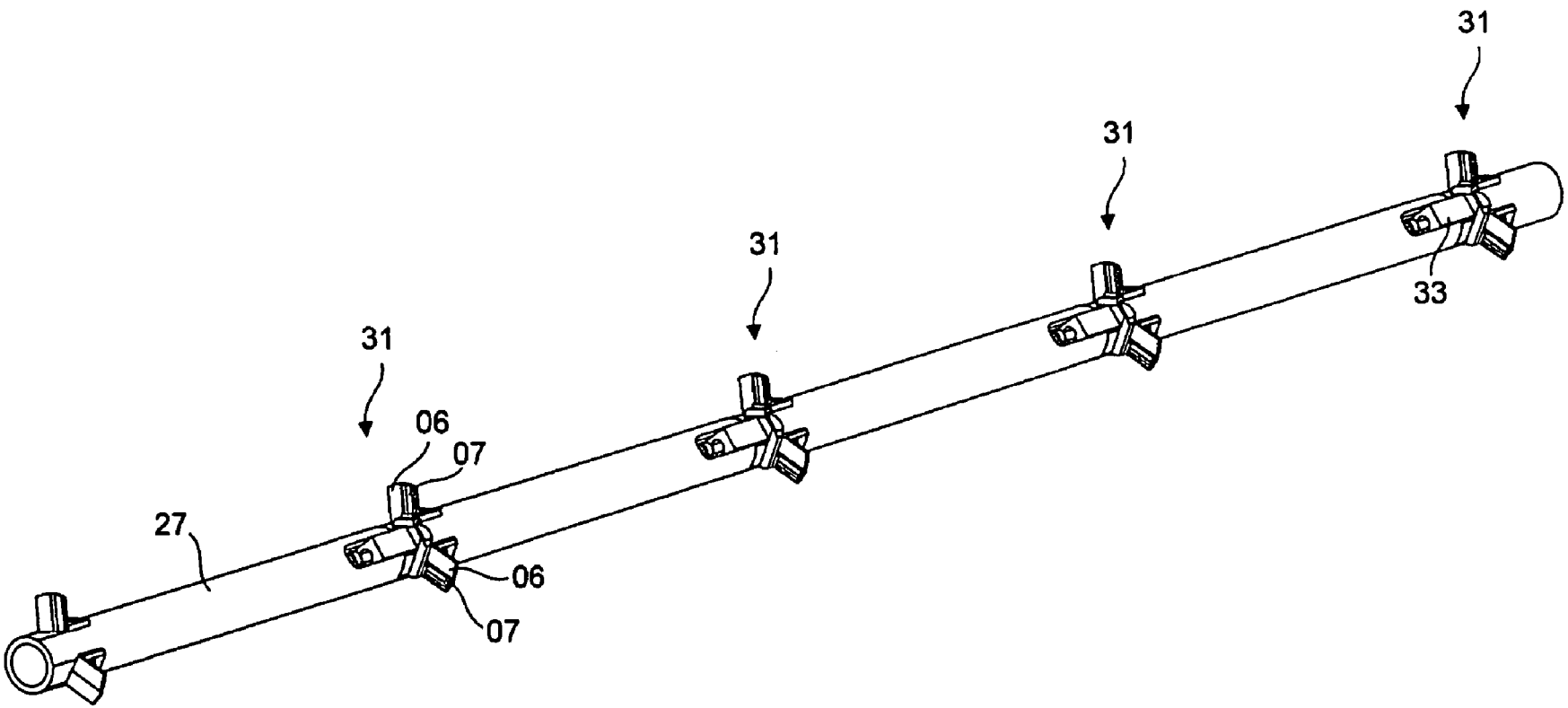
in FIG. 4 a perspective view of a cross member with spring-mounted stops.
Figure 5:
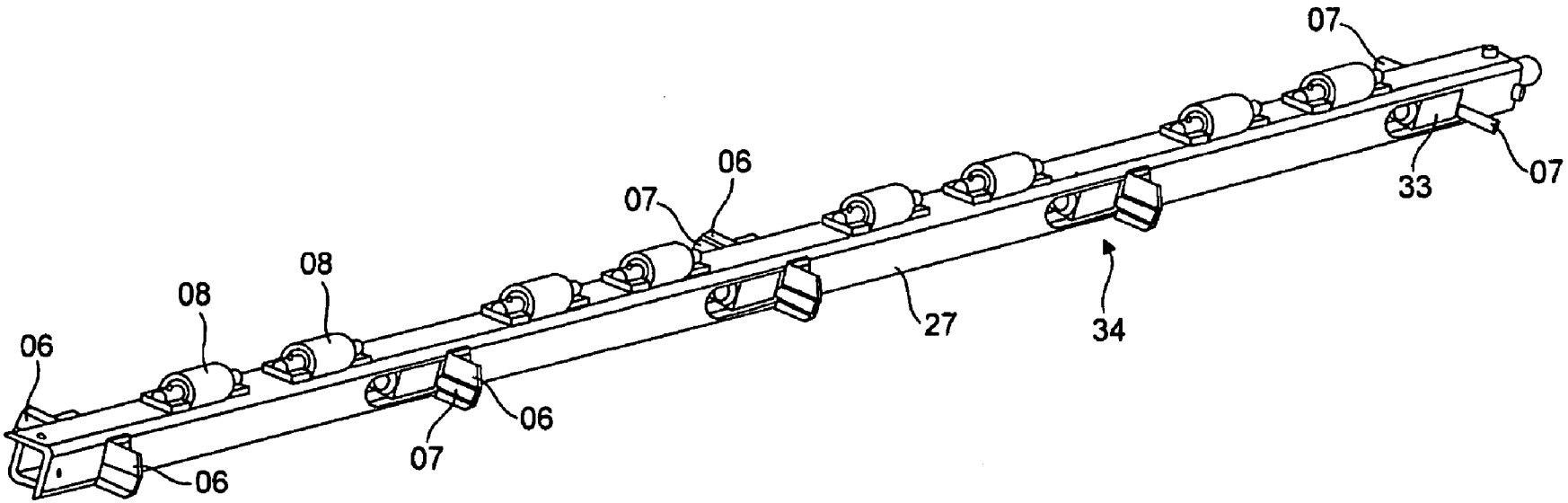
in FIG. 5 a perspective view of a cross member with spring-mounted stops and with rollers.
Figure 6:
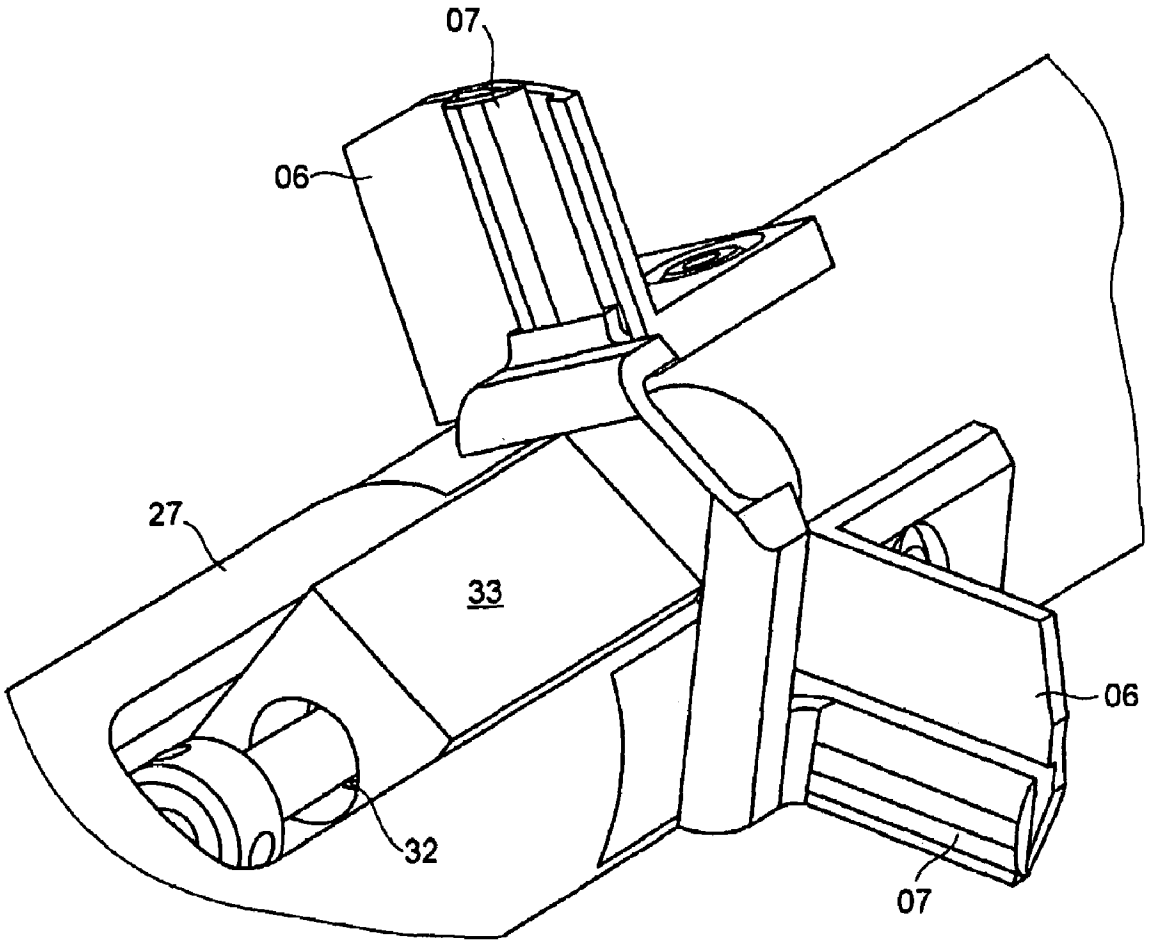
in FIG. 6 a detailed perspective view of a portion of the cross member shown in FIG. 4; and in FIG. 7 a longitudinal sectional view through the cross member.
Figure 7:
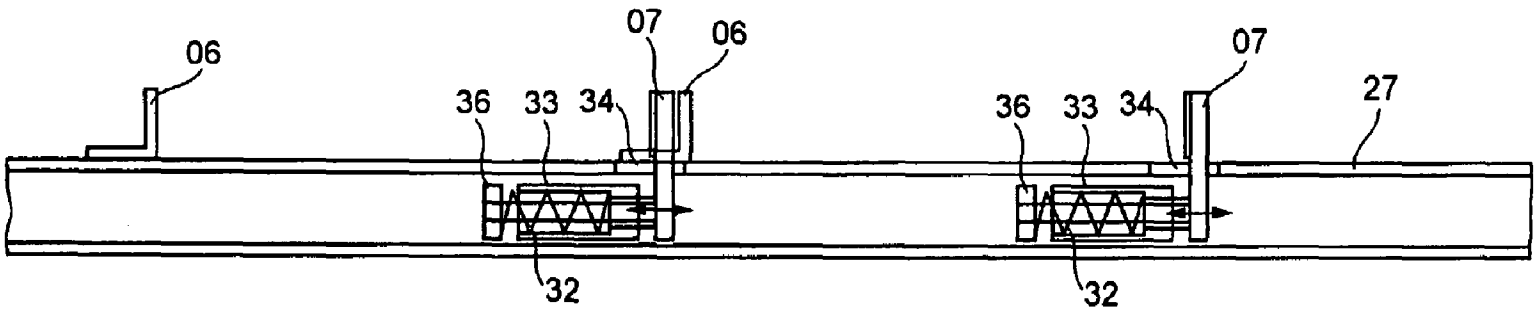

One embodiment of stops 06; 07 that are mounted in a bearing 31, with a spring element 32 which acts in the axial direction of the forme cylinder 01, is represented in FIG. 4 through 7, wherein FIG. 6 shows a detailed view of FIG. 4. For purposes of clarity, in FIG. 2 and 3 only each stop 06; 07 that is rigidly arranged relative to the cross member 27 is illustrated. In FIG. 5, all of the stops 06; 07 that are required in the overall device depicted in FIG. 2 and 3 are shown. FIG. 7 shows a portion of a longitudinal section through the cross member 27, which cross member 27 is preferably structured as a hollow profile. The hollow profile of cross member 27 has, for example, a round cross-section, as seen in FIG. 4 or a rectangular cross section, as seen in FIG. 5, and preferably has a square cross-section. In FIG. 4 through 7, the stop that is rigid, with respect to the cross member 27, is indicated by the reference symbol 06, and the stop that is axially movable, relative to the cross member 27, is indicated by the reference symbol 07. These reference symbols 06; 07 are hereinafter used in accordance with this assignment. In FIG. 4, the stops 06; 07 are arranged on the cross member 27, and are offset around the circumference of the cross member 27 at an obtuse angle with respect to each other. In FIG. 5 each stop 06; 07 is positioned with an offset in the circumferential direction, of 180°. Both the stop that is rigid with respect to the cross member 27, and which has the reference symbol 06, and the stop that is axially movable with respect to the cross member 27, and which has the reference symbol 07, can be structured to be adjustable in the axial direction of the cross member 27, at least within a certain adjustment range. Each stop's property of being rigid or axially movable relates only to the operational state in which it can laterally align and/or can guide a printing forme 02 to be fed to the forme cylinder 01 during the infeed process.

In the example which is shown in FIG. 4 through 6, inside the cross member 27, on each bearing 31 of a stop 07 that is movable in the axial direction of the forme cylinder 01 a linear guide 33 is provided. The stop 07 that is movable in the axial direction of the forme cylinder 01 is, in each case, stationarily fastened to a movable part of the linear guide 33. Stops 06, that are structured to be immovable, in the axial direction of the forme cylinder 01, are stationarily fixed to the cross member 27 based upon their axial positioning that is selected beforehand. The cross member 27 is equipped with an opening 34, such as, for example, a longitudinal hole 34 which is oriented in the axial direction of the forme cylinder 01, at each of the positions of the movable stops 07. The opening 34 is provided for the purpose of connecting the respective movable stop 07 with the linear guide 33 that is disposed inside the cross member 27. The spring element 32 is arranged inside the linear guide 33 or on the end surface of the linear guide 33 and is connected, at one end, to a fixed mount 36 that is not movable relative to the cross member 27, as seen in FIG. 7. The spring element 32 is structured, for example, as a spring 32, particularly as a helical, cylindrical or discoid spring 32, as a springy element 32, such as, for example, as a sufficiently soft rubber pad, or as a parallelogram shift which is comprised of two coordinating spring plates. A spring deflection of the spring element 32, and which is oriented in the axial direction of the forme cylinder 01, ranges, for example, from ±0.5 mm to approximately 2 mm, and preferably from ±0.5 mm to 1 mm. The spring element 32 is preferably prestressed.

The linear guide 33 can be shifted axially, within a maximum allowable shifting path, as determined by the spring deflection of the spring element 32, by virtue of a force that is applied to the movable stop 07 that is connected to the linear guide 33, in the axial direction of the forme cylinder 01, which is indicated in FIG. 7 on each movable stop 07 by a double arrow which is oriented parallel to the cross member 27. A fluctuation, which may be caused, for example, during forme production, in the width of the printing forme 02 that is to be fed to the forme cylinder 01, and which fluctuation extends in the axial direction of the forme cylinder 01, can be compensated for, as needed, and a jamming of the printing forme 02 to be fed in to the forme cylinder 01 can be prevented, as the printing forme 02 is being fed into the forme cylinder 01. Despite the flexibility, or the shiftability of the movable stop 07 that is connected to the linear guide 33, the printing forme 02 that is to be fed to the forme cylinder 01, obtains sufficient lateral stability, as a result of the spring-mounted bearing of this movable stop 07, for its register-true infeed to the forme cylinder 01. Because of the provision of the spring-mounted movable stop 07, the at least one edge 14; 16 of this printing forme 02, which at least one edge 14; 16 is trimmed in relation to the printed image of the printing forme 02, is both reliably laterally aligned on the stop 06 that is rigid relative to the cross member 27, and is also reliably guided on this rigid stop 06 during the infeed of this printing forme 02.

At least the stop 07 that is movably mounted in the axial direction of the forme cylinder 01 can have, on its side which faces the printing forme 02 that is to be fed to the forme cylinder 01, a guiding aid for that printing forme 02, which guiding aid may be, for example, in the form of a groove that is recessed or formed in the stop surface. The stop 07, that is mounted to be movable in the axial direction of the forme cylinder 01, is structured, for example, as a pin or as a land that protrudes perpendicular from the cross member 27. The stop 06, that is rigidly connected to the cross member 27, is structured to be angular, with a comparatively large guide surface which faces the printing forme 02 that is to be fed to the forme cylinder 01.

The printing forme 02, which is to be fed to the forme cylinder 01, during the infeed process, or during its transport movement which is directed toward the forme cylinder 01, is passed between the stops 06; 07 in a preferably sliding direct contact with the stops 06; 07. In this movement, on one hand, the printing forme 02 exerts a force on the stop 07 that is mounted so as to be movable in the axial direction of the forme cylinder 01, and against the spring element 32. On the other hand, the printing forme 02, in reaction to its support against the stop 07 that is mounted so as to be movable in the axial direction of the forme cylinder 01, and during its transport movement which is directed toward the forme cylinder 01, is pressed against the stop 06 that is rigidly arranged relative to the cross member 27 and which stop 06 is assigned to this printing forme 02. A coordination of the device 04 for guiding the printing forme 02 that is structured with the stops 06; 07 and the printing forme 02 that is produced to be register-true, accomplishes a positioning of the printing forme 02 on the circumferential surface of a forme cylinder 01. This positioning, which is precise, at least in terms of lateral register, can be achieved, because continuously throughout the entire assembly process, a fixed relationship is maintained between the printed image that is applied to the printing forme 02 via imaging and the positioning of that printing forme 02 on the forme cylinder 01, which is achieved with the help of the stops 06; 07.

While preferred embodiments of a method for feeding a printing forme to a forme cylinder of a printing press, a method for producing a printing forme and a device for laterally aligning and guiding a dressing that is to be fed to a printing press cylinder, in accordance with the present invention, have been set forth fully and completely hereinabove, it will be apparent to one of skill in the art that various changes in, for example, the type of printing press being used, the number of printing formes carried on the forme cylinder and the like could be made without departing from the true spirit and scope of the present invention which is accordingly to be limited only by the appended claims.

What is claimed is:

1. A method for feeding a printing forme to a forme cylinder of a printing press including:

providing a printing forme having a type area;

applying markings to at least one side of said printing forme which is to be bent down for forming a forme cylinder engaging end;

determining a boundary line of said type area using said markings;

trimming at least one edge of said printing forme parallel to said boundary line;

bending down said at least one side of printing forme bearing said markings;

providing a printing forme feeding device having at least one axially effective stop;

placing said printing forme on said printing forme feeding device;

using said feeding device for precisely positioning said printing forme on said forme cylinder in an axial direction of said forme cylinder; and using said at least one axially effective stop for guiding said at least one trimmed edge of said printing forme.

2. The method of claim 1 further including providing at least two of said stops, positioning said two stops spaced from each other in said axial direction of said forme cylinder and passing said printing forme to be fed to said forme cylinder between said two stops.

3. The method of claim 2 further including using at least one of said at least two stops for aligning said at least one trimmed edge of said printing forme.

4. The method of claim 3 further including providing a second printing plate side spaced from, and parallel to said trimmed side and engaged said second printing plate side using said other of said at least two stops.

5. The method of claim 4 further including providing said other of said at least two stops having a spring force and using said spring force for pressing said other of said at least two stops against said second printing plate side.

6. The method of claim 1 further including applying said making to said printing forme during imaging of said type area.

7. The method of claim 1 further including trimming said at least one edge after imaging said printing forme.

8. The method of claim 1 further including bending down said at least one side of said printing forme at a bending angle of between 45° and 135°.

9. The method of claim 1 further including bending down said at least one side of said printing forme at a bending angle of 45°±10°.

10. The method of claim 1 further including bending down said at least one side of said printing forme at a bending angle of 90°±10°.

11. The method of claim 1 further including implementing said trimming of said at least one edge of said printing forme and said bending down of at least one side of said printing forme in the same direction.

* * * * *